United States Patent [19]

Takahashi

[11] 4,317,406

[45] Mar. 2, 1982

[54] HYDRAULIC CYLINDER FOR GENERATING VIBRATIONS

[75] Inventor: Ikuo Takahashi, Yokohama, Japan

[73] Assignee: Kabushiki Kaisha Takahashi Engineering, Japan

[21] Appl. No.: 171,527

[22] Filed: Jul. 23, 1980

Related U.S. Application Data

[63] Continuation of Ser. No. 907,071, May 18, 1978, abandoned.

[51] Int. Cl.[3] ..... F15B 21/02; F15B 15/17

[52] U.S. Cl. ..... 91/39; 91/417 R; 91/470

[58] Field of Search ..... 91/39, 417 R, 470

[56] References Cited

U.S. PATENT DOCUMENTS

| | | | |
|---|---|---|---|
| 2,402,300 | 6/1946 | Shimer | 91/39 |
| 2,876,742 | 3/1959 | Sherill | 91/39 |
| 3,368,457 | 2/1968 | Lewakowski | 91/39 |
| 3,678,803 | 7/1972 | Schwenzfeier | 91/39 |

*Primary Examiner*—Paul E. Maslousky

*Attorney, Agent, or Firm*—William A. Drucker

[57] ABSTRACT

A hydraulic cylinder for generating vibrations which comprises: a cylinder body; a hollow piston rotatably mounted in said cylinder body; and a valve rotor rotatably engaged within said hollow piston, said valve rotor having a change-over valve portion adapted to be rotated for applying hydraulic loads to said piston alternately in axially opposite directions.

4 Claims, 8 Drawing Figures

HYDRAULIC CYLINDER FOR GENERATING VIBRATIONS

This is a continuation of Ser. No. 907,071, filed May 18, 1978, now abandoned.

BACKGROUND OF THE INVENTION

The present invention relates to a hydraulic cylinder for generating vibrations, and more particularly to a hydraulic cylinder for generating mechanical vibrations adapted for use in various mechanical workings performed through vibrations or adapted to be supplied to pile drivers, rock drills, and the like.

Generally known as the above-mentioned type of apparatus is an apparatus disclosed, for example, in Japanese Patent Provisional Publication No. 21580/72. This disclosed apparatus is arranged such that if the piston 101 of a hydraulically-actuated cylinder 100 has only one side thereof loaded with return force (e.g., by a spring 109) as shown in FIG. 1(*a*), a pipe 104 is connected to a hydraulic pressure chamber 102 on the other side not loaded with return force, through which pipe a hydraulic pressure fluid medium such as oil supplied from a reservoir 108 via a hydraulic pressure source 107 such as a pump P is supplied into and exhausted from the hydraulic pressure chamber 102 in an alternate fashion by means of control valve means 106, so that the pressure in the hydraulic pressure chamber 102 is alternately increased and decreased to cause reciprocating motion of the piston 101 in the axial directions thereof. While, if the piston has either side thereof adapted to be loaded with return force as in FIG. 1 (*b*), a hydraulic pressure medium is alternately charged into and discharged from the hydraulic pressure chambers 102 and 103 on both sides of the piston, by means of control valve means 106.

However, this conventional apparatus has the following defects: The cylinder 100 and the control valve means 106 are provided separately from each other and are connected with each other by means of pipes 104 and 105, with the result that when either of the hydraulic pressure chambers 102 and 103 of the cylinder 100, e.g., chamber 102 is being supplied with hydraulic pressure oil, the pressure in the chamber 102 is not elevated up to a sufficient level until the fluid of an amount corresponding to the inside volume of the pipe 104 becomes fully compressed, and on the other hand, when the hydraulic pressure chamber 102 is connected with the exhaust line, there occurs a time lag in the decrease of pressure in the chamber by an amount corresponding to the time required for the expansion of said fluid. That is, such conventional vibrating cylinder has its operating motion delayed in proportion to the volume of the fluid present in the connection pipe(s), and consequently when the cylinder is operated at a high vibration frequency, it can difficultly have a required amplitude of vibration. Further, if a high-output vibrating cylinder is used, a considerably large amount of hydraulic energy is consumed for compressing the fluid in the pipe(s) to supply hydraulic pressure to the cylinder.

BRIEF SUMMARY OF THE INVENTION

It is a primary object of the invention to provide a novel hydraulic cylinder for generating vibrations which is so excellent in response as to easily obtain a required amplitude of vibration even when used at a high vibration frequency.

It is a further object of the invention to provide a hydraulic cylinder for generating vibrations which is so compact in size that the hydraulic pressure supply energy required for its operation can be small.

BRIEF DESCRIPTION OF THE DRAWINGS

These and other objects, advantages, features, and uses will become more apparent by referring to the following description when considered with the accompanying drawings in which.

DETAILED DESCRIPTION OF THE INVENTION

Figure 1A:
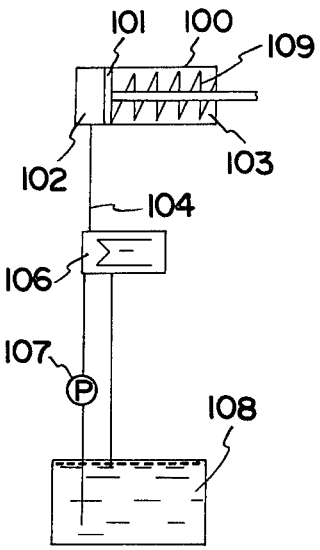
FIG. 1 (*a*) and (*b*) are schematic block diagrams illustrating conventional arragements in which operating cylinders are caused to vibrate by means of separate control valves.
Figure 1B:
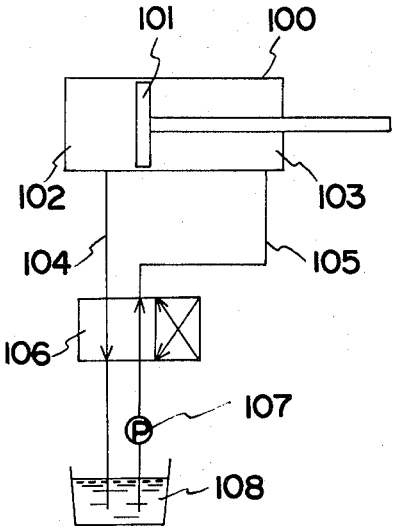
Figure 2:
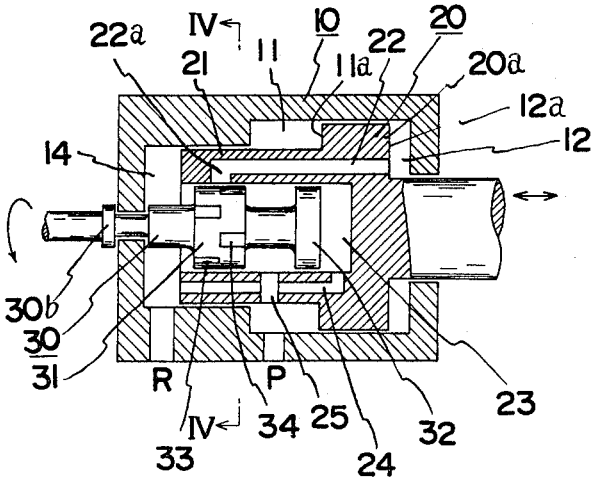
FIG. 2 is a sectional side elevation illustrating a first embodiment according to the present invention.
Figure 3:
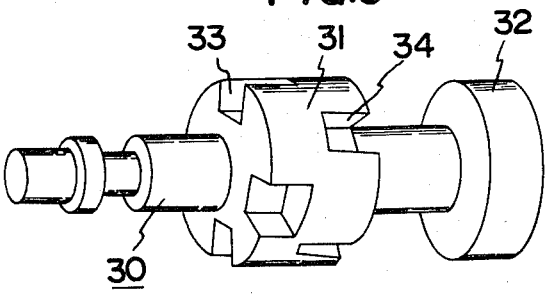
FIG. 3 is a perspective view illustrating a valve rotor used in the first embodiment of the present invention.

Referring now to FIG. 2 showing a first embodiment of the invention a hollow cylinder body having a generally cylindrical shape is designated by reference numeral 10. Supported in said cylinder body 10 is a piston of a generally cylindrical shape for sliding movement therein. Said piston has a hollow portion 21 within which a valve rotor 30 is rotatably engaged to form an element of a rotary control valve to be described later. Said rotor 30 has an end portion 30*b* with a smaller diameter inserted through an end face hole of the cylinder body 10, and said end portion 30*b* is provided with a stopper adjacent to an outer end face wall of the cylinder body 10 which stopper impedes axial movement of the valve rotor 30 in cooperation with a middle portion with a larger diameter situated adjacent to the end portion 30*b*. Provided on the valve rotor 30 in spaced relation to the end portion 30*b* is a change-over valve portion 31, while the valve rotor 30 has a free end thereof formed as another larger-diameter portion 32 located in axially spaced relation to said change-over valve portion 31 and having substantially the same diameter as said valve portion 31. As more distinctly shown in FIG. 3 and FIG. 4, the change-over valve portion 31 has a peripheral surface thereof formed with two trains of notches 33 and 34 disposed at respective sides of a radial plane of the valve portion 31, said notches circumferentially extending and arranged at equal intervals. It should be noted that the notches 33 and 34 are arranged in an alternate fashion with respect to the axis of the rotor. It will be understood from the above description that the piston 20 and the valve rotor 30 cooperate with each other to form a rotary control valve with the piston serving as a valve stator with respect to the rotor 30.

Defined by loading inner faces 11*a*, 12*a* of the piston 20, i.e., front and rear side faces of a flanged portion 20*a* thereof, and by inner peripheral walls of the hollow cylinder body 10 are two annular fluid chambers 11 and 12. Of these chambers, the chamber 11 which faces the loading face 11*a* having a smaller area communicates with a fluid supply connection port P formed through a peripheral wall of the cylinder body 10 so that it is permanently kept under fluid pressure.

Figure 4:
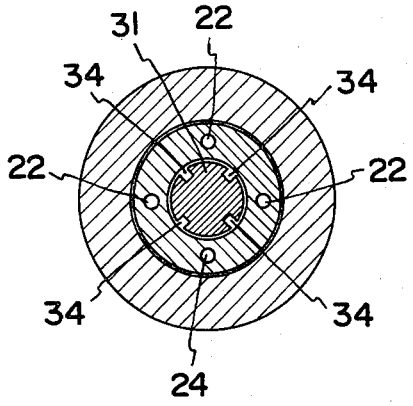
FIG. 4 is a sectional view taken along line IV—IV of FIG. 2.

The piston 20 also has a portion of the peripheral wall thereof provided with a port 25 for allowing the fluid chamber 12 to communicate with the hollow chamber 21 in the piston. On the other hand, said hollow chamber 21 communicates with the fluid chamber 11 facing the loading face 12*a* having a larger area through ports 22 axially extending in the piston (In this embodiment, as seen in FIG. 4, three pieces are provided circumferentially of the piston). The change-over valve portion 31 which constitutes a large-diameter portion of the valve rotor 30 is arranged in engagement with mouths 22*a* of the ports 22 opening in the hollow portion 21 of the piston. A port 25 is formed in the portion of the peripheral wall of the piston facing a region defined by the change-over valve portion 31 and the large-diameter portion 32 within the hollow portion of the piston, for allowing the hollow portion 21 to communicate with said fluid chamber 11. Defined by an end of the piston 20 opposite to the end at which the fluid chamber 12 is formed and by the change-over valve portion 31 is a fluid chamber 14 which communicates with a return connection port R formed in the periphery of the piston. Also, another fluid chamber 23 is defined at the free end of the valve rotor 30 by the large-diameter portion 32 of the valve rotor 30 in the hollow part 21 of piston 20, which is in communication with the chamber 14 via a fluid path 24 axially extending in the piston 20.

The manner of operation of the above-mentioned embodiment will be explained hereinbelow: As noted above, the fluid chamber 11 facing the loading face 11*a* with a smaller area of the piston is kept under permanent pressure produced by a hydraulic pressure source not shown through the supply connection port P. The valve rotor 30 of the rotary control valve is made to rotate. During this rotation, the notches 33 and 34 in two trains of change-over valve portion 31 engage with the openings 22*a* of the ports 22 alternately with each other. While notches 33 engages with the mouths 22*a*, the fluid chamber 12 can communicate with the return connection port R via fluid paths 22 and fluid chamber 14, so that the pressure in the chamber 11 surpasses the pressure in the chamber 12 to cause the piston to move in the rightward direction as viewed in FIG. 2. When the valve rotor 30 is further rotated so that the notches 34 come into engagement with the openings 22*a* (To avoid that the other notches 33 may engage with these openings 22*a* at this time, the distance between a notch 33 and its associated notch 34 in the circumferential sense of the change-over valve portion 31 is designed to be larger than the width of the opening 22*a*, i.e., the diameter of said opening 22*a* in the circumferential sense of the piston), the fluid chamber 12 can now communicate with the chamber 11 via fluid paths 22, hollow portion 21 of the piston and port 25 so that the pressure in the chamber 12 becomes equal to that in the chamber 11. Since the loading face 12*a* of the piston facing the chamber 12 is larger than the loading face 11*a* facing the chamber 11, the piston 20 is made to move in the leftward direction as viewed in FIG. 2. Thus, as the valve rotor 30 rotates, the change-over valve portion 31 allows the fluid paths 22 to communicate alternately with the supply connection port P and the return connection port R to cause reciprocating motion or vibration of the piston 20. The piston 20 is given a vibration frequency equaling $N \times n$, provided that N is the rotational frequency of the valve rotor 30, and n the number of notches.

According to the above-described first embodiment of the present invention, the rotary control valve and the cylinder are arranged as one integral body. This arrangement excludes an superfluous space such as connection fluid paths that causes a delay in the compression and expansion cycle of the hydraulic cylinder, resulting not only in high response of the hydraulic cylinder to the change-over action of the fluid paths by means of the rotary control valve, but also in feasibility of obtaining mechanical vibrations of a sufficient amplitude at a high vibration frequency. Further, since the piston also serves as a valve stator for the rotary control valve, and at least one of the fluid chambers facing the loading faces of the piston on opposite sides thereof is located on the same radial plane as the valve rotor, the fluid paths or ports communicating with said fluid chamber can be designed to have the minimum length and the minimum volume that are indispensable for the ports per se, which also leads to compactness and simplicity in the construction of the hydraulic cylinder, as well as to smaller consumption of hydraulic pressure supply energy required for the operation of the cylinder.

In the above-described embodiment, it is noted that there is still a considerable distance between the notches 33 or 34 of the change-over valve portion 31 and the fluid chamber 12, that is, the paths 22 have a large length. Therefore, the pressure in the chamber 12 is not increased to a sufficient level after its connection to the supply connection port P by the change-over valve until the fluid in the paths 22 becomes fully compressed, and further the pressure in the same chamber 12 is not decreased to a required level until said fluid is fully expanded, causing a delay in the motion of the vibrating cylinder which corresponds to the volume of the paths 22 so that in the event of operation at a high vibration frequency the cylinder cannot have a required amplitude of vibration and moreover in the event of a high-output vibrating cylinder being used, a considerable amount of hydraulic pressure supply energy is required for compressing the fluid in said paths.

Figure 5:
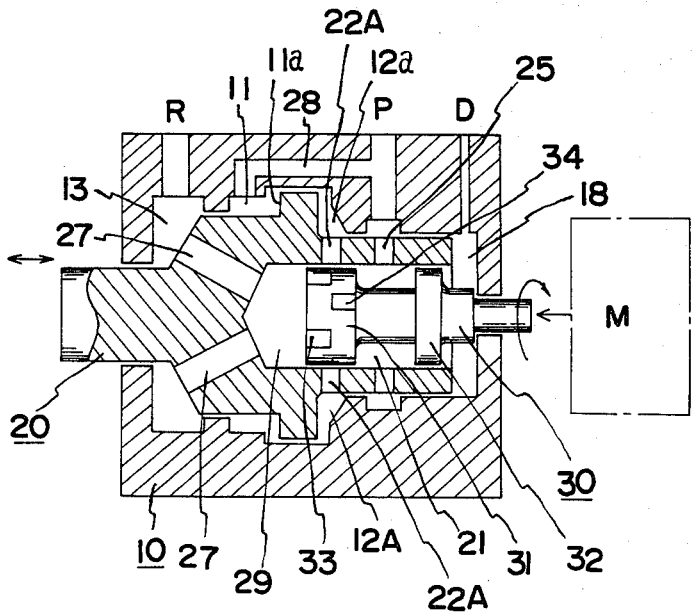
FIG. 5 is a sectional side illustrating a second embodiment according to the present invention.

FIG. 5 is a second embodiment of the invention which has substantially completely eliminated the above-mentioned defect. According to this embodiment, a fluid chamber 12A which corresponds to the fluid chamber 12 of the first embodiment is now formed on the same radial plane as the change-over valve portion 31 of the valve rotor 30, in a fashion facing the change-over valve portion 31 via radial ports 22A having an inappreciable length. Thus, the distance between the fluid chamber 12A and the change-over valve portion 31 is largely reduced. With this arrangement, the ports 22A have an ignorable volume and accordingly the cylinder can easily produce mechanical vibrations of a required amplitude even at a high vibration frequency. By the way, in this embodiment, the fluid chamber 11 facing the smaller loading face 11*a* of the piston is always charged under pressure with fluid fed through a port 28 communicating with the supply connection port P, to axially urge the acting face 11*a* of the piston. Under this arrangement, when the notches 33 of the change-over valve portion 31 are in engagement with the ports 22A, the fluid chamber 12A is in communication with the return connection port R via ports 22A, a fluid chamber 29, ports 27 and a fluid chamber 13. While, when the notches 34 engage with the ports 22A, the chamber 12A communicates with the supply connection port P via ports 25 and a fluid chamber 21. Incidentally, in FIG. 5, D represents a drain connection port for allowing leakage of fluid into a fluid chamber 18.

Figure 6:
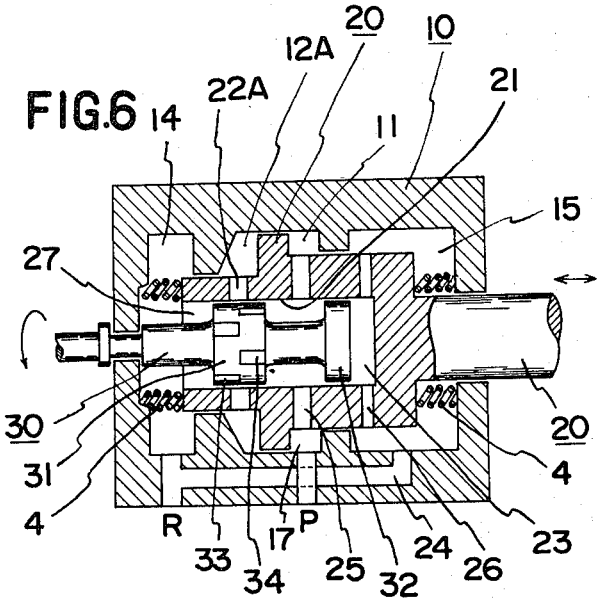
FIG. 6 is a sectional side elevation illustrating a modification of the second embodiment of the present invention.

FIG. 6 is a modification of the second embodiment of the invention. Also in this modification, the fluid chamber 12A is located on the same radial plane as the change-over valve portion 31 via short ports 22A extending only radially to bring about similar results to those obtained by the above-mentioned second embodiment. It should however be noted that as distinct from the second embodiment, the smaller loading chamber 11 is located on the same radial plane as the supply connection port P to make a little more simple the whole construction of the cylinder. In FIG. 6, reference numeral 15 represents a drain chamber formed at an end opposite to the end at which the fluid chamber 14 is located, which communicates with an end fluid chamber 23 delimited by the large-diameter portion 32 of the valve rotor 30 through ports 26 and further communicates with the return connection port R through a port 24. Reference numerals 4, 4 designate coil springs provided at opposite ends of the piston 20 for supporting the piston substantially at a center of the cylinder body. Since the apparatus of FIG. 6 thus has a similar essential construction to that of the apparatus of FIG. 5, its manner of operation is the same as that of the latter.

Figure 7:
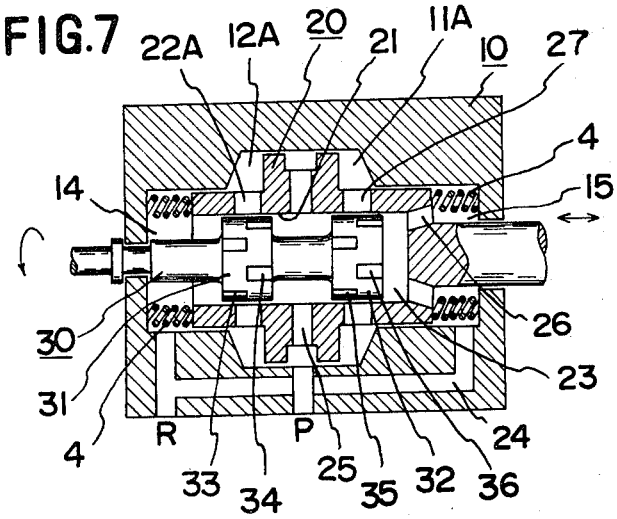
FIG. 7 is a sectional side elevation illustrating a third embodiment according to the present invention.

Referring next to FIG. 7, description will be made of another embodiment of the invention. All the embodiments hereinbefore described pertain to the type in which, of the two loading chambers oppositely arranged in the moving direction of the piston, the one facing the smaller loading face of the piston is always kept under hydraulic pressure while the other one facing the larger loading face of the piston is made to communicate alternately with the supply connection port P for applying hydraulic pressure thereto and with the return connection port R for exhausting fluid therefrom, thus obtaining mechanical vibrations. However, according to the third embodiment to be described now, the two loading faces oppositely arranged with respect to the moving direction of the piston have the same area, and while one of the two fluid chambers facing these loading faces at opposite sides of the piston is being supplied with fluid, the other chamber has fluid therein being exhausted, to cause vibrating motion of the piston.

In FIG. 7 illustrating the third embodiment, corresponding elements are designated by corresponding numerals with respect to FIGS. 2–6, and reference to these numerals is omitted here. In FIG. 7, as different from the embodiments of FIGS. 2–6, the two fluid chambers at opposite sides of the piston with respect to the moving direction of the piston 20 are now designated by reference numerals 11A and 12A, which chambers are adapted to communicate with the hollow portion 21 of the piston through ports 22A and 27, both formed in the peripheral wall of the piston, respectively. The mouth portions of these ports 22A and 27 opening in the interior of the piston are engaged by the respective change-over valve portions 31 and 32 of the valve rotor 30, said change-over valve portions 31 and 32 being formed with two trains of notches 33 and 34, and two trains of 35 and 36 respectively.

The manner of operation of this embodiment will be explained below: Suppose that the rotation of the valve rotor 30 has now brought the notches 34 of the change-over valve portion 31 into engagement with the ports 22A, as seen in the drawing. At this time, the fluid chamber 12A is made to communicate with the supply connection port P through ports 22A, hollow portion 21 and ports 25 to undergo hydraulic pressure by fluid supplied therein. On the other hand, the chamber 11A on the other side is made to communicate with the return connection port R via fluid chamber 23 at the free end of the valve rotor 30, ports 26, fluid chamber 15, and fluid path 24 owing to engagement of the notches 36 of the change-over valve 32 with the ports 27. Thus, the pressure in the chamber 12A surpasses that in the chamber 11A to cause the piston 20 to move in the rightward direction as viewed in FIG. 7. When the valve rotor 30 further rotates to allow the notches 33 of the change-over valve portion 31 to engage with the ports 22A, the fluid chamber 12A is now made to communicate with the return connection port R via fluid chamber 14, while owing to engagement of the notches 35 of the change-over valve 32 with the ports 27, the other chamber 11A is made to communicate with the supply connection port P via hollow portion 21 and ports 25, so that the pressure in the chamber 11A now surpasses that in the chamber 12A to cause the piston 20 to move leftwardly as viewed in FIG. 7. In this manner, the piston 20 is made to make axially reciprocating or vibrating motion as the valve rotor 30 rotates.

Reverting now to the aforedescribed first embodiment of the invention, reference will be made to the self-equilibration of the piston 20, that is, the capability of the center of reciprocation of the piston remaining in a given axial position. Referring to FIG. 2, suppose that the notches 34 of the change-over valve portion 31 now engage with the mouths of ports 22 to cause the piston 20 to leftwardly move. As the piston moves leftwardly, the open area at which the mouths of ports 22 and the notches 34 engage with each other decreases so that the pressure in the chamber 12 decreases to cause the piston 20 to be moved back into a position of equilibrium and remain there. That is, in the vibrating cylinder according to the present invention, any displacement of the piston is fed back to the rotary control valve, thus imparting self-equilibration to the piston. Whilst, the pistons in the embodiments shown in FIGS. 6 and 7 do not have such self-equilibration, and coil springs 4 are employed to impart self-equilibration to them.

While the invention has been described in its preferred embodiments, it is to be understood that modifications will occur to those skilled in that art without departing from the spirit of the invention. The scope of the invention is therefore to be determined solely by the appended claims.

What is claimed is

1. A hydraulic device, for generating vibratory motion, comprising:

(i) a cylinder body having a supply connection port and an exhaust connection port opening into its interior for passage of hydraulic pressure fluid medium, (ii) a piston slidable within said cylinder body and including a valve chamber, said piston comprising radial flange means having at axially opposite sides thereof a larger face and a smaller face, a first chamber being defined by said larger face and the inner surface of the cylinder body, a second chamber being defined by the smaller face and the inner surface of the cylinder body, the second chamber communicating with the supply port, the first chamber communicating with valving port means opening into the valve chamber, (iii) a valve rotor positioned within and rotatable about an axis within said valve chamber, said rotor including a change-over valve portion having an outer circumferential surface disposed opposite to said valving port means, said change-over valve portion having therein first and second circumferential trains of notches opening at said outer circumferential surfaces, the notches of each train being arranged at equal circumferential intervals, the notches of the first train being arranged angularly alternately with respect to the notches of the second train, the notches of the first train being permanently in communication with the supply connection port, the notches of the second train being permanently in communication with the exhaust connection port, the first and second trains of notches being disposed at different axial positions on the rotor such that, when the piston is in a central position of its stroke within the cylinder body, axially-adjacent ends of the notches of the two trains lie between the planes normal to the axis of rotation of the rotor which respectively coincide with the opposed axial limits of the valving port means.

2. The hydraulic cylinder as claimed in claim 1, wherein said first fluid chamber is located on a radial plane the same as said change-over valve portion of said valve rotor.

3. The hydraulic cylinder as claimed in claim 2, wherein said first and second fluid chambers are located on radial planes the same as said respective change-over valve portion.

4. A hydraulic device, as claimed in claim 1, wherein said first chamber is disposed to be axially coincident with said valving port means so as to communicate with the valve chamber directly through said valving port means.

* * * * *